United States Patent [19]

Lautenschläger, Jr. et al.

[11] Patent Number: 4,698,877

[45] Date of Patent: Oct. 13, 1987

[54] CABINET HINGE

[75] Inventors: Karl Lautenschläger, Jr.; Horst Lautenschläger, both of Reinheim, Fed. Rep. of Germany

[73] Assignee: Karl Lautenschläger KG, Reinheim, Fed. Rep. of Germany

[21] Appl. No.: 841,959

[22] Filed: Mar. 20, 1986

[30] Foreign Application Priority Data

Mar. 22, 1985 [DE] Fed. Rep. of Germany ..... 3510442

[51] Int. Cl.[4] ..... E05D 7/04

[52] U.S. Cl. ..... 16/235; 16/236

[58] Field of Search ..... 16/235, 236, 240, 246, 16/370, 382, DIG. 43

[56] References Cited

U.S. PATENT DOCUMENTS

| | | | |
|---|---|---|---|
| 3,940,829 | 3/1976 | Grunert et al. | 16/246 |
| 4,313,239 | 2/1982 | Tsuneki | 16/236 |
| 4,376,324 | 3/1983 | Lautenschäger et al. | 16/236 |
| 4,430,771 | 2/1984 | Salice | 16/235 |

FOREIGN PATENT DOCUMENTS

| | | | |
|---|---|---|---|
| 2049800 | 12/1980 | United Kingdom | 16/DIG. 43 |

*Primary Examiner*—M. Jordan

[57] ABSTRACT

In a hinge for hanging flush overlap doors, the door-related hinge part which can be mounted on the door is coupled by an articulation mechanism to a carcase-related hinge part in the form of an elongated supporting arm which in turn is secured to a mounting plate fastened to the door-supporting wall of a cabinet carcase. By means of an adjusting screw thrusting against the supporting arm or against the mounting plate and threaded into the mounting plate or supporting arm, as the case may be, an adjustment of the overlap or coverage dimension of the door on the front edge of the supporting wall is possible. The fastening which secures the supporting arm on the mounting plate is in the form of a pivot system with a pivot axis running parallel to the pivot axis of the articulation mechanism. The pivot system is configured such that, when the adjusting screw is turned in the sense of a reduction of the overlap dimension, a displacement of the supporting arm toward the carcase interior is superimposed on the resultant swing of the supporting arm, and this displacement compensates the enlargement of the gap between the inside of the door and the front edge of the supporting wall which results from the geometry of the articulation mechanism.

8 Claims, 17 Drawing Figures

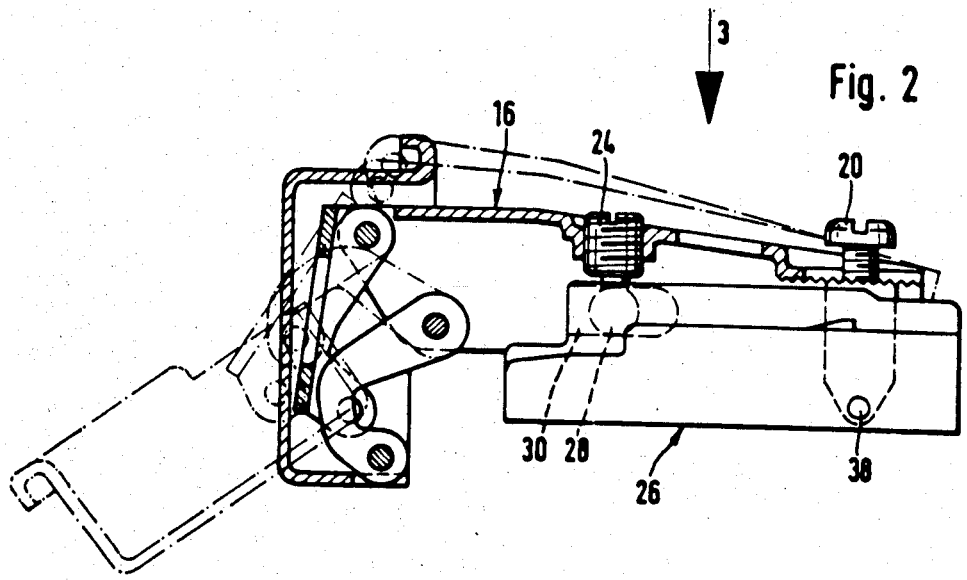
Fig. 2
Fig. 3
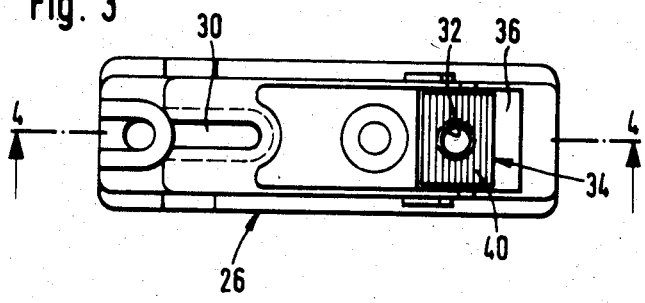
Fig. 4
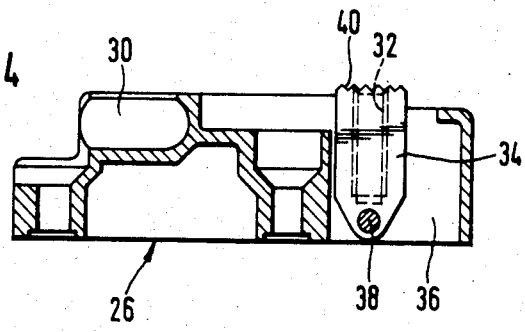

Fig. 5
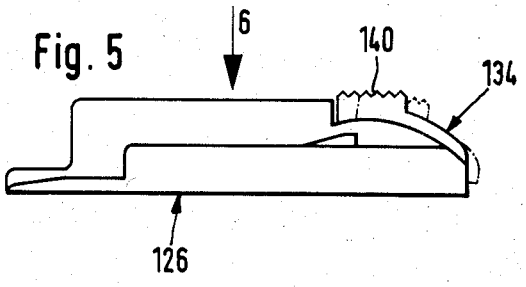
Fig. 6
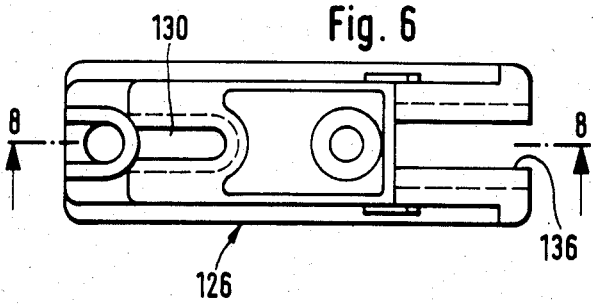
Fig. 7
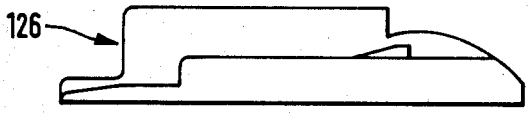
Fig. 8
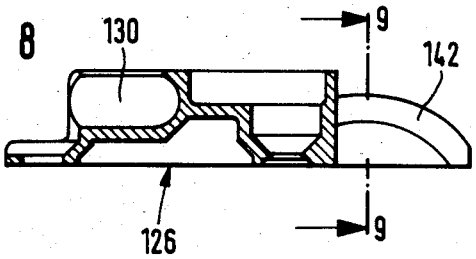
Fig. 9
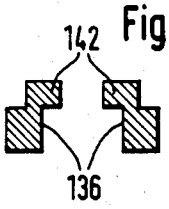
Fig. 10
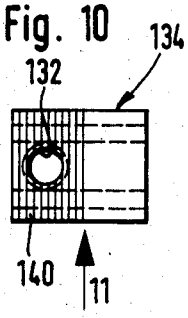
Fig. 11
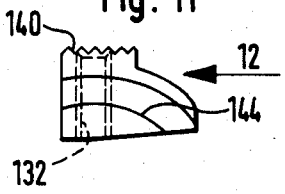
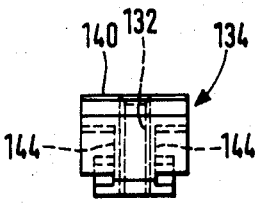
Fig. 12

CABINET HINGE

BACKGROUND OF THE INVENTION

The invention relates to a hinge for the hanging of flush overlay or lipped doors on a cabinet carcase, the hinge having a door-related part attachable to the door, which is coupled through an articulation, preferably a four-joint or crosslink articulation, to a carcase-related part in the form of an elongated supporting arm which in turn is secured at at least one point to a mounting plate fastened to the supporting wall of a cabinet carcase against lifting away from the mounting plate and is made adjustable, by means of an adjusting screw thrusting against the supporting arm or mounting plate at a distance from the point of fastening to the supporting arm, with regard to the overlap or coverage dimension of the door on the front edge of the supporting wall.

Such hinges, which are invisible when the door is closed, are in widespread use in modern furniture construction, especially in connection with the above-mentioned flush overlay or lipped doors, because the action of their articulation produces the movement of the door with a pronounced component that draws the whole door away from the front edge of the carcase wall at the beginning of the opening movement, which is needed for this kind of door. That is to say, when a door hung on a cabinet carcase with this kind of hinge is opened, the inside face of the door, which is lying flat against the front edge of the supporting wall in the closed state, at first lifts sharply away from the edge of the supporting wall, while the actual swinging movement of the door to the open position does not begin to any great extent until the door is sufficiently far away from the front edge to be able to open without interfering with the door of a directly adjacent cabinet or cabinet compartment. At the same time, these hinges are adjustable in at least two—often three—directions approximately at right angles to one another, so as to permit the precise alignment of the door with the corresponding cabinet carcase and, in some cases, also with adjacent doors (of other compartments). These adjustments relate on the one hand to the tight engagement of the inside face of the door with the front edges of the side walls, and in some cases with the bottom and top of the carcase, and on the other hand to the so-called overlap or coverage dimension, i.e., the dimension by which the inside face of the door overlaps the front edge of the supporting wall. These adjustments are made possible by securing the hinge's supporting arm on a mounting plate fastened to the supporting wall, in such a manner as to be displaceable longitudinally and fixable at any longitudinal position, and on the other hand by securing the supporting arm on the mounting plate such that its front end adjacent the door can be angled with respect to its carcase-internal end and locked in selectable angular positions. When the overlap dimension of a door hung with such a hinge on a cabinet carcase is adjusted, however, the above-described hinge articulation has the effect that, without a simultaneously performed longitudinal adjustment, the distance between the inside face of the door and the front edge of the supporting wall is altered, such that an increasingly large gap forms between the inside face of the door and the front edge of the supporting wall as the hinge is increasingly adjusted to reduce the overlap or coverage dimension. The reason for this undesirable widening of the gap lies in the fact that the shifting of the supporting arm of the hinge results in a swinging—however slight—of the door. But, since the marginal portion of the door opposite the hinges also lies against the front edge of the carcase wall at that point, it is impossible for this margin of the door to swing in the direction of the carcase interior, and instead the door transmits a slight opening movement to the articulation of the hinge. This initial opening movement, however, leads, as described above, to a comparatively sharp lift-away component of movement, which is the cause of the formation of the gap.

It is therefore the object of the invention to design the above-described articulated hinges such that the overlap adjustment can be performed without any marked change of the distance between the inside face of the closed door in the marginal area and the associated front edge of the supporting wall.

SUMMARY OF THE INVENTION

Setting out from a hinge of the kind described above, this object is achieved according to the invention in that the fastening which secures the supporting arm against lifting away from the mounting plate has a pivot axis disposed parallel to the pivot axis of the articulation, and that the pivot system is such that a displacement of the supporting arm toward the carcase interior is superimposed on the supporting arm pivoting movement that takes place when the adjustment screw is turned to reduce the overlap dimension, and this compensates the enlargement of the gap between the inner face of the door and the front edge of the supporting wall resulting from the action of the articulation.

If the supporting arm is secured to the mounting plate by means of a fastening screw threaded into a tap in the mounting plate, the configuration is preferably made such that the tap is provided in a rocker body which is mounted pivotingly on or within the mounting plate.

The desired compensatory movement is then obtained when the pivot axis of the rocker body is shifted toward the carcase supporting wall from its clamping surface.

If the mounting plate in which the pivot axis of the rocker body is still within the mounting plate is sufficiently high, the configuration can then best be such that the mounting plate straddles the rocker body in the area of the pivot axis and the pivot axis is formed by a pivot pin passing through aligned bores in the rocker body and mounting plate. On the other hand, the rocker body can also be mounted in a lower mounting plate if the pivot axis of the rocker body which then is straddled by the mounting plate accordingly is sufficiently far away from the surface on which the supporting arm is clamped. The supporting arm must then be modified accordingly, at least in the area where it is clamped on the rocker body.

If the pivot axis of the rocker body has to be situated—in the case of a low mounting plate—below the surface on which the mounting plate is fastened, i.e., virtually buried in the supporting wall, the rocker body is coupled to the mounting plate by the fact that one straddles the other, and in the confronting overlapping surfaces of the rocker body and mounting plate at least one arcuate ridge projecting from the one surface engages a complementary arcuate groove in the associated surface. If the radius of the arc is appropriate, then the rocking movement can be achieved without a physical pivot axis.

Another possibility for securing the supporting arm on the mounting plate is for the pivot system to have a pivot pin held in bores in lugs of the supporting arm which straddle the mounting plate. This pivot pin passes through one or more slots in the mounting plate which run substantially parallel to the supporting wall of the carcase and have a width corresponding approximately to the diameter of the pivot pin. The adjusting screw slopes from a perpendicular erected on the supporting wall from its mounting-plate-associated end into the interior of the carcase, its angle of inclination determining the amount by which it displaces the supporting arm when the overlap dimension is adjusted, the simultaneously pivoting and displaceable securing of the supporting arm to the mounting plate being made possible by the slots through which the pivot pin passes. The mounting-plate end of the adjusting screw is best held such that it can be rotated but not shifted longitudinally while the thread of the adjusting screw is in threaded engagement with a complementary tap in the supporting arm.

BRIEF DESCRIPTION OF THE DRAWING

The invention is further explained in the following description of a number of embodiments, in conjunction with the drawing, wherein:

FIG. 2 represents, partially in section, an arrangement of the supporting arm of a four-joint hinge on a mounting plate which is provided, according to a first embodiment of the invention, with a rocker body for the supporting arm fastening screw, FIG. 3 shows a top plan view of the mounting plate, as seen in the direction of the arrow 3 in FIG. 2.

FIG. 4 is a cross sectional view seen in the direction of the arrows 4—4 in FIG. 3, . FIG. 5 is a side view of a mounting plate representing a modification of the mounting plate shown in FIGS. 2 to 4, FIG. 6 is a top view of the mounting plate with the rocker body removed, as seen in the direction of the arrow 6 in FIG. 5, FIG. 7 is a side view of the mounting plate shown in FIG. 6 without the rocker body, FIG. 8 is a sectional view seen in the direction of the arrows 8—8 in FIG. 6, FIG. 9 is a sectional view seen in the direction of the arrows 9—9 in FIG. 8, FIG. 10 is a top view of the rocker body of the mounting plate of FIG. 5, FIG. 11 is a side view of the rocker body seen in the direction of the arrow 11 in FIG. 10, FIG. 12 is a rear view of the rocker body, seen in the direction of the arrow 12 in FIG. 11.

DETAILED DESCRIPTION OF PREFERRED EMBODIMENTS

Figure 1:
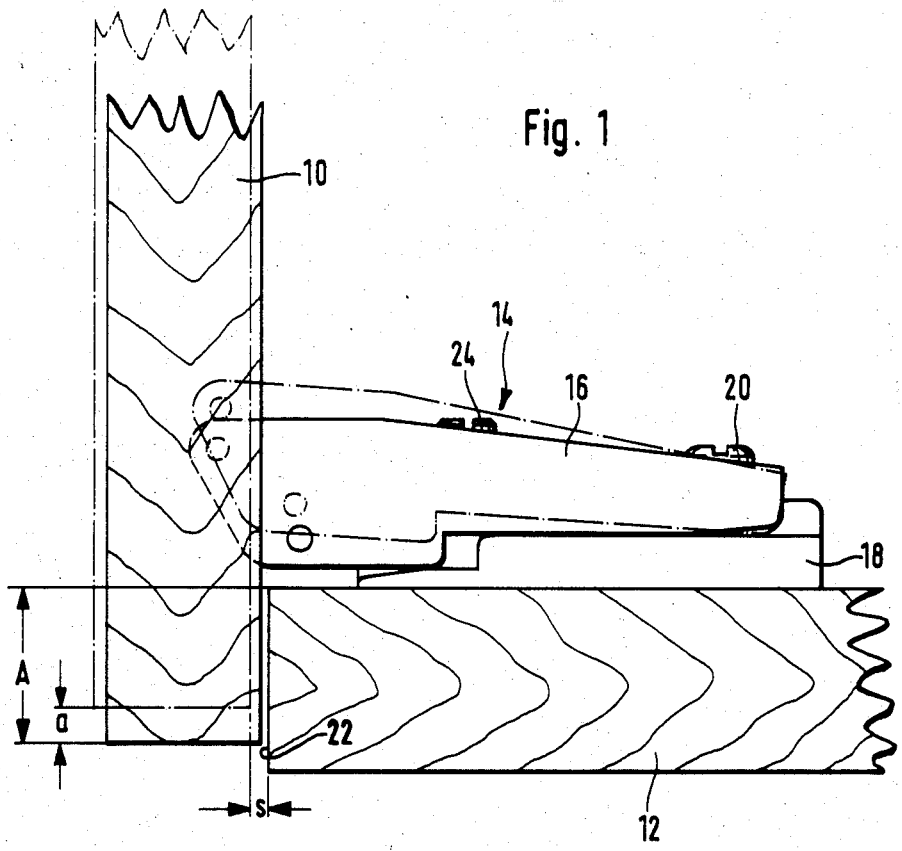
FIG. 1 represents a horizontal section through the front, free end area of the supporting wall of a cabinet carcase and of the marginal section of the associated door mounted on the supporting wall by a four-joint hinge, the change in the gap between the inside face of the door and the front edge of the supporting wall that is made when the door overlap is adjusted being represented in broken lines in addition to the starting position.

To permit visualization of the problem, there is shown in FIG. 1 the mounting of a door 10, represented in the closed position on the supporting wall 12, by means of a known four-joint hinge 14, of which only the supporting-wall-related part in the form of the supporting arm 16 and the mounting plate 18 which holds the supporting arm 16 and is fastened to the supporting wall 12 are shown in FIG. 1. The door-related hinge part, is as a rule in the form of a cup 15 (see FIGS. 2 and 13) fastened flush in a mortise on the inside of the door, and a four-joint mechanism 17 formed by two hinge links 19, 21 couples the door-related hinge part articulately to the supporting arm, these parts are not described in detail, since the modifications made in the hinges according to the invention, to be described below in conjunction with FIGS. 2 to 17, are limited to the supporting-wall-related part of such hinge. Let it be assumed that the hinge 14 is forced, by a fastening screw 20 passing through a slot provided at the carcase-interior end and driven into the mounting plate 18, against a mounting surface of the mounting plate. Then, after the fastening screw 20 has been loosened, the supporting arm 16 can be shifted longitudinally on the mounting plate 18 and then, by tightening the fastening screw, can be fixed in the desired position. Thus the gaps existing between the inside face of the door and the front edge 22 of the supporting wall 12 can be varied even when the door 10 is closed. By means of an adjusting screw 24 threaded in a tap in the supporting arm 16 and thrusting with its inner end against the mounting plate 18—being possibly also secured against lifting away from the mounting plate—it is also possible to vary the overlap A of the door on the front edge 22. By turning the adjusting screw 24 into the supporting arm—with the fastening screw 20 again slightly loosened—the front end of the supporting arm 16, i.e., the one adjacent the door, can be shifted to the position represented in broken lines in the drawing; this results in a reduction of the overlap A of the door by the amount a. Although the front end of the supporting arm is adjusted over an arc, while also a slight displacement toward the carcase interior takes place and thus the door 10 would have to be drawn against the edge 22 of the supporting wall 12, a contrary effect is produced, on account of the previously described characteristic of the four-joint mechanism. The gaps becomes larger, i.e., the door 10 assumes the position represented in the drawing in broken lines. Such an enlargement of the gaps, however, is undesirable for visual and practical reasons (entry of dust through the gap into the cabinet interior).

In FIG. 2, there is shown how the (unmodified) supporting arm 16 is fastened on a modified mounting plate 26 represented separately in FIGS. 3 and 4, which, when the overlap A is changed by turning the adjusting screw 24, automatically compensates the otherwise resulting change in the size of the gaps. The configuration of mounting plate 26 corresponds largely to the configuration of known mounting plates such as those disclosed in German Offenlegungsschrift No. 32 23 937, so there all that will be stated here is that, on the front end of the adjusting screw 24, at the mounting plate, there is formed an enlarged holding head 28 which is held in an elongated groove 30 which is open at the front end of the mounting plate 26 and narrowed along its upper side by lips projecting from the lateral margins.

What is novel and essential to the invention is the arrangement of the tap 32 for the fastening screw 20 in a separately made rocker body 34 which in turn is pivotingly mounted in a recess 36 in the carcase-interior end portion of the mounting plate. This mounting is performed by means of a pivot pin 38 passing through aligned bores in the rocker body 34 and through the walls of mounting plate 26 which laterally define the recess 36.

It is now clear that, if a change is made in the overlap by turning the adjusting screw 24 to the position of supporting arm 26 represented in broken lines in FIG. 2, the rocker body 34 will rock accordingly toward the carcase interior, in which case the movement into the case interior that is necessary for the compensation of the gap enlargement is superimposed on the supporting arm 16 held tightly clamped on the mounting surface 40 of rocker body 34 surrounding the tap 32. By the appropriate selection of the position of the pivot axis of the rocker body a virtually complete compensation of the change in the gap is possible for the range of adjustment that is involved.

The mounting plate 126 shown in FIGS. 5 to 11 is functionally much the same as mounting plate 26. The mounting plates 26 and 126 differ only in the manner in which the rocker body is pivotally mounted so that only this different pivot arrangement is described below, whereas otherwise it is sufficient to refer to the above description of mounting plate 26, inasmuch as, in the case of mounting plate 126, the same reference numbers, prefixed by the numeral 1, are associated with parts serving the same function.

The rocker body 134 is again disposed in a recess 136 in the rearward end portion of the mounting plate 126 and has the tap 132 for the fastening screw 20. The recess 136 has in this case the form of a slot that is open at the carcase-interior end, and from whose confronting surfaces arcuately shaped ridges 142 project to which complementary arcuate grooves 144 in rocker body 134 correspond. The rocker body 134 can thus be inserted into the recess 136 from the rearward end such that the ridges 142 engage the grooves 144. The position of the pivot axis of the rocker body 134 is then determined by the radius of the arcuately curved ridges and grooves and, in the case of mounting plate 126, it is below the mounting flange of the mounting plate 126 on the supporting wall.

Figure 13:
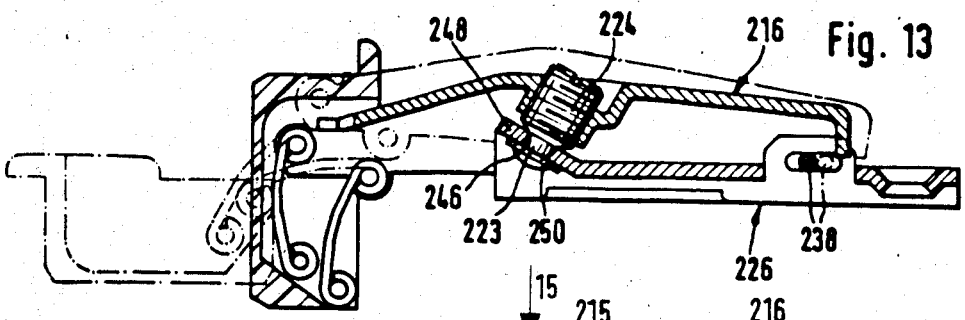
FIG. 13 is a longitudinal central section through the supporting arm, fastened on the corresponding mounting plate, of an additional embodiment of the hinge according to the invention.
Figure 14:
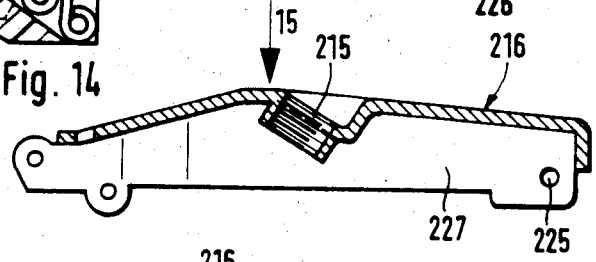
FIG. 14 is a longitudinal central section of the supporting arm of the embodiment represented in FIG. 13, dismounted from the mounting plate.
Figure 15:
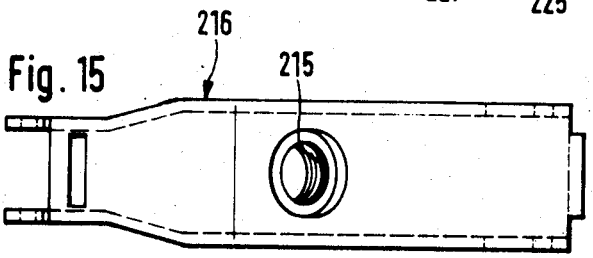
FIG. 15 is a top view of the supporting arm seen in the direction of the arrow 15 in FIG. 14.
Figure 16:
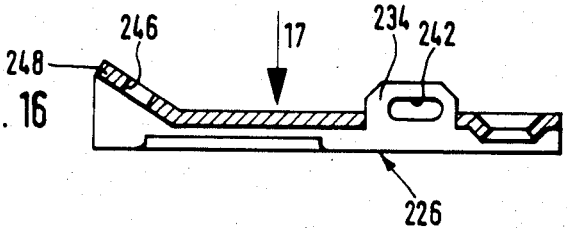
FIG. 16 is a longitudinal central section of the mounting plate of the embodiment represented in FIG. 13.
Figure 17:
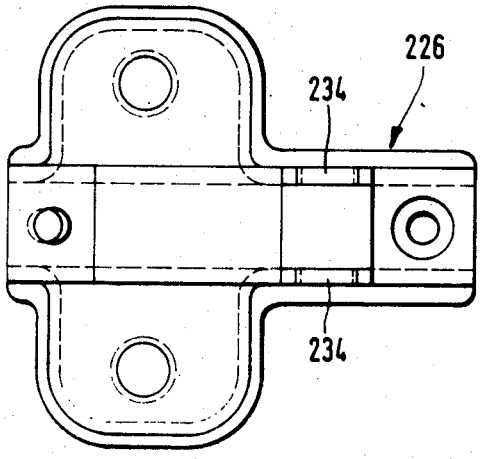
FIG. 17 is a top view of the mounting plate, seen in the direction of the arrow 17 in FIG. 16.

An embodiment that is quite different from the preceding one is represented in FIG. 13 which shows how a hinge supporting arm 216 (FIGS. 14 and 15) is mounted on a mounting plate 226 (FIGS. 16 and 17) in the form of a so-called wing plate made by stamping from sheet steel.

The rocker body arrangement in this case is formed by a pivot pin 238 held in bores 225 in the sides 227 of the supporting arm 216 which straddle the central portion of the mounting plate 226; the pivot pin 238 also engages two slots 242 running substantially parallel to the carcase supporting wall, which are formed in lugs 234 bent upwardly from the sheet metal material of the mounting plate. The supporting arm 216 can thus rock on the pivot pin 238 held in the slots 224, and is furthermore held for longitudinal displacement on the mounting plate within the range permitted by the length of the slots.

The adjustment of the amount of overlap is performed by means of the adjusting screw 224 threaded into a tap 215 in the supporting arm 216 at a point forward, i.e., toward the door end, from the pivot pin 238. The adjusting screw 224 has at its mounting plate end a neck section 223 of reduced diameter which is engaged in a bore 246 in an upwardly bent section 248 of the front end of the mounting plate, and can rotate but, on account of a disk 250 fastened on the free end of the neck section 223, it is held against longitudinal displacement in the bore 246. The central axis of the adjusting screw 224 and of the corresponding tap 215 in the supporting arm, is inclined rearwardly, i.e., toward the interior of the carcase, in the manner seen in FIGS. 13 and 14, and this inclination is selected such that an adjustment of the overlap dimension of the hinge to the position indicated in broken lines in FIG. 13 will result in a rearward displacement of the supporting arm 216 by such an amount that the enlargement of the gaps produced by the geometry of the articulation is barely compensated. The rearward displacement of the supporting arm 216 is possible because the pivot pin 238 is able to shift by the required amount in the slot 242.

It is apparent that modifications and further developments of the embodiments described above can be made within the scope of the idea of the invention, in connection with the kind of hinge that is used and also the method by which a door is mounted on the cabinet carcase. The gap compensation according to the invention can also be desirable in the case of crosslink hinges intended for larger door opening angles. It can also be applied to hinges for rabbeted overlap doors or—in special cases—also for flush doors.

We claim:

1. A hinge for hanging a flush overlay or lipped door on a cabinet carcase having a supporting wall with a front edge forming a gap with the door, said hinge comprising: a door-related part for attaching to the door, a carcase-related part forming an elongated supporting arm, an articulation mechansim coupling the door-related part to the carcase-related part and having a first pivot axis, a mounting plate having a mounting surface for mounting to the supporting wall, means for fastening said supporting arm to said mounting plate, and for securing said supporting arm against being lifted away from a contact surface with said mounting plate, and an adjusting screw thrusting against one of said supporting arm and mounting plate, at a distance from said fastening means, for adjusting overlap of the door with respect to the front edge, said securing means comprising a pivot system with a second pivot axis disposed parallel to the first pivot axis, said securing means being a rocker body pivotable about said second pivot axis, being located at said mounting plate and having a tap, and a fastening screw threaded into the tap, said pivot system being constructed such that a displacement movement of the supporting arm away from the front edge and from the door is superimposed on a swinging movement of the supporting arm upon turning the adjusting screw in a direction reducing the overlap, said displacement movement compensating the enlargement of the gap resulting from kinematics of the articulation mechanism.

2. A hinge according to claim 1, wherein the second pivot axis is closer to the mounting surface than the contact surface.

3. A hinge according to claim 1, wherein the rocker body and the mounting plate overlap one another at the second pivot axis, and said second pivot axis is formed by a pivot pin passing through aligned bores in the rocker body and the mounting plate.

4. A hinge according to claim 2, wherein the rocker body and the mounting plate overlap one another at the second pivot axis, and said second pivot axis is formed by a pivot pin passing through aligned bores in the rocker body and the mounting plate.

5. A hinge according to claim 1, wherein the rocker body and the mounting plate have confronting overlapping surfaces, and at least one projection projecting arcuately from the one overlapping surface and engaging an arcuately curved groove in the other overlapping surface.

6. A hinge according to claim 2, wherein the rocker body and the mounting plate have confronting overlapping surfaces, and at least one projection projecting arcuately from the one overlapping surface and engaging an arcuately curved groove in the other overlapping surface.

7. A hinge for hanging a flush overlay or lipped door on a cabinet carcase having a supporting wall with a front edge forming a gap with the door, said hinge comprising: a door-related part for attaching to the door, a carcase-related part forming an elongated supporting arm having lugs with bores, an articulation mechanism coupling the door-related part to the carcase-related part and having a first pivot axis, a mounting plate having a mounting surface for mounting to the supporting wall, means for fastening said supporting arm to said mounting plate, and for securing said supporting arm against being lifted away from a contact surface with said mounting plate, and an adjusting screw thrusting against one of said supporting arm and mounting plate, at a distance from said fastening means, for adjusting overlap of the door with respect to the front edge, said securing means comprising a pivot system with a second pivot axis disposed parallel to the first pivot axis, said pivot system having a pin held in said bores in said lugs, said lugs overlapping said mounting plate on opposite sides, said mounting plate having a slots running substantially parallel to the mounting surface, and having a width corresponding approximately to the diameter of the pivot pin, said pivot pin passing through said slots, and the adjusting screw being inclined with respect to a perpendicular to the mounting surface away from the first pivot axis, said pivot system being constructed such that a displacement movement of the supporting arm away from the front edge and from the door is superimposed on a swinging movement of the supporting arm upon turning the adjusting screw in a direction reducing the overlap, said displacement movement compensating the enlargement of the gap resulting from kinematics of the articulation mechanism.

8. A hinge according to claim 7, wherein the adjusting screw has an end secured rotatably, but longitudinally undisplaceably in the mounting plate, and a threaded shaft in threaded engagement with a complementary threaded bore in the supporting arm.

* * * * *